US010295928B2

(12) United States Patent
Akiba

(10) Patent No.: US 10,295,928 B2
(45) Date of Patent: May 21, 2019

(54) IMAGE FORMING APPARATUS FOR FORMING IMAGES IN MULTIPLE RESOLUTION MODES

(71) Applicant: CANON KABUSHIKI KAISHA, Tokyo (JP)

(72) Inventor: Kazuhiro Akiba, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/704,455

(22) Filed: Sep. 14, 2017

(65) Prior Publication Data

US 2018/0095378 A1 Apr. 5, 2018

(30) Foreign Application Priority Data

Oct. 5, 2016 (JP) ..... 2016-197547

(51) Int. Cl.
*G03G 15/00* (2006.01)
*G03G 15/043* (2006.01)

(52) U.S. Cl.
CPC ..... *G03G 15/043* (2013.01); *G03G 15/5058* (2013.01)

(58) Field of Classification Search
CPC ..... G03G 15/043; G03G 15/5041; G03G 15/5058; G03G 2215/00025; G03G 2215/00029; G03G 2215/00037; G03G 2215/00042; G03G 2215/0426; G03G 2215/0429
See application file for complete search history.

(56) References Cited

U.S. PATENT DOCUMENTS 6,124,870 A * 9/2000 Morimoto ..... G06K 15/1223 347/131
6,463,227 B1 * 10/2002 Denton ..... G03G 15/5058 347/131
2006/0127114 A1 6/2006 Mizuno ..... 399/49
(Continued)

FOREIGN PATENT DOCUMENTS

JP 2000-177171 6/2000
JP 2013-120195 A 6/2013

OTHER PUBLICATIONS

Extended European Search Report dated Feb. 2, 2018 in counterpart European Application No. 17189299.5.

*Primary Examiner* — Thomas S Giampaolo, II
(74) *Attorney, Agent, or Firm* — Venable LLP

(57) ABSTRACT

An image forming apparatus includes an image processing unit configured to perform image processing corresponding to an image forming mode on image data; a controller configured to control the image processing unit to perform the image processing corresponding to the image forming mode on measurement image data, control an image forming unit to form the measurement image based on the measurement image data, to control a measurement unit to measure the measurement image, and to control an image forming condition based on a measurement result. In a case where the measurement image is formed while the image forming apparatus consecutively forms a plurality of images in the second image forming mode, the controller controls the image forming unit to form the measurement image without performing the image processing corresponding to the second image forming mode.

10 Claims, 11 Drawing Sheets

(56) References Cited

U.S. PATENT DOCUMENTS

2008/0117445 A1* 5/2008 Masuda ..... G03G 15/326
358/1.9
2008/0166147 A1* 7/2008 Kim ..... G03G 15/50
399/39
2011/0304867 A1* 12/2011 Tokoyama ..... G03G 15/5041
358/1.9

* cited by examiner

FIG. 8A

| | | |
|---|---|---|
| 0 | 8 | 0 |
| 0 | 16 | 0 |
| 0 | 8 | 0 |

FIG. 8B

| | | |
|---|---|---|
| 0 | 0 | 0 |
| 0 | 32 | 0 |
| 0 | 0 | 0 |

IMAGE FORMING APPARATUS FOR FORMING IMAGES IN MULTIPLE RESOLUTION MODES

BACKGROUND OF THE INVENTION

Field of the Invention

The invention relates to an image forming apparatus which forms images in multiple resolution modes.

Description of the Related Art

There is a method in which, if a resolution of received image data is higher than a resolution that can be formed in an image forming apparatus, a resolution in a main scanning direction is maintained by halving tone information of the image data. Also, for a sub-scanning direction, by halving the process speed, it is possible to write at twice the density, and thereby realize a high resolution even in the sub-scanning direction. However, image forming productivity decreases because of the process speed is halved in this method. For this reason, Japanese Patent Laid-Open No. 2013-120195 discloses that a pseudo-high resolution printing technique in which pixels on odd-numbered scanning lines are thinned out, and instead, image data of pixels on the scanning line to be thinned out is distributed in image data of preceding/succeeding pixels in the sub-scanning direction.

The image forming apparatus, in order to maintain image quality of an image to be formed, forms a test image for image adjustment at a predetermined timing, and adjusts an image forming condition by reading the formed test image by a sensor. There are also cases in which this image adjustment processing is performed while forming an image on a plurality of recording materials, and not only when not forming an image. However, as in the disclosure of Japanese Patent Laid-Open No. 2013-120195, if processing (hereinafter referred to as distribution processing) for dispersing image data in the sub-scanning direction for image forming in a high resolution mode is performed, distribution processing is also performed on the test image, and the test image may not be formed as intended. Meanwhile, when a normal resolution mode is temporarily switched into in order to perform image adjustment processing while performing image forming to recording materials in the high resolution mode, a processing delay accompanying the switching occurs.

SUMMARY OF THE INVENTION

According to an aspect of the present invention, an image forming apparatus forms an image in an image forming mode of image forming modes including a first image forming mode for forming an image with a first resolution and a second image forming mode for forming an image with a second resolution different from the first resolution. The image forming apparatus includes an image processing unit configured to perform image processing corresponding to the image forming mode on image data; an image forming unit configured to form an image based on the image data for which the image processing is performed by the image processing unit; a measurement unit configured to measure a measurement image formed by the image forming unit; a controller configured to control the image processing unit to perform the image processing corresponding to the image forming mode on measurement image data, control the image forming unit to form the measurement image based on the measurement image data, to control the measurement unit to measure the measurement image, and to control an image forming condition based on a measurement result of the measurement image. In a case where the measurement image is formed while the image forming apparatus consecutively forms a plurality of images in the second image forming mode, the controller controls the image forming unit to form the measurement image without performing the image processing corresponding to the second image forming mode.

Further features of the present invention will become apparent from the following description of exemplary embodiments with reference to the attached drawings.

BRIEF DESCRIPTION OF THE DRAWINGS

FIGS. 8A and 8B are views illustrating a filter.

DESCRIPTION OF THE EMBODIMENTS

Exemplary embodiments of the present invention will be described hereinafter, with reference to the drawings. Note, the following embodiments are examples and the present invention is not limited to the content of the embodiments. Also, for the following drawings, configuration elements that are not necessary in the explanation of the embodiment are omitted from the drawings.

Figure 1:
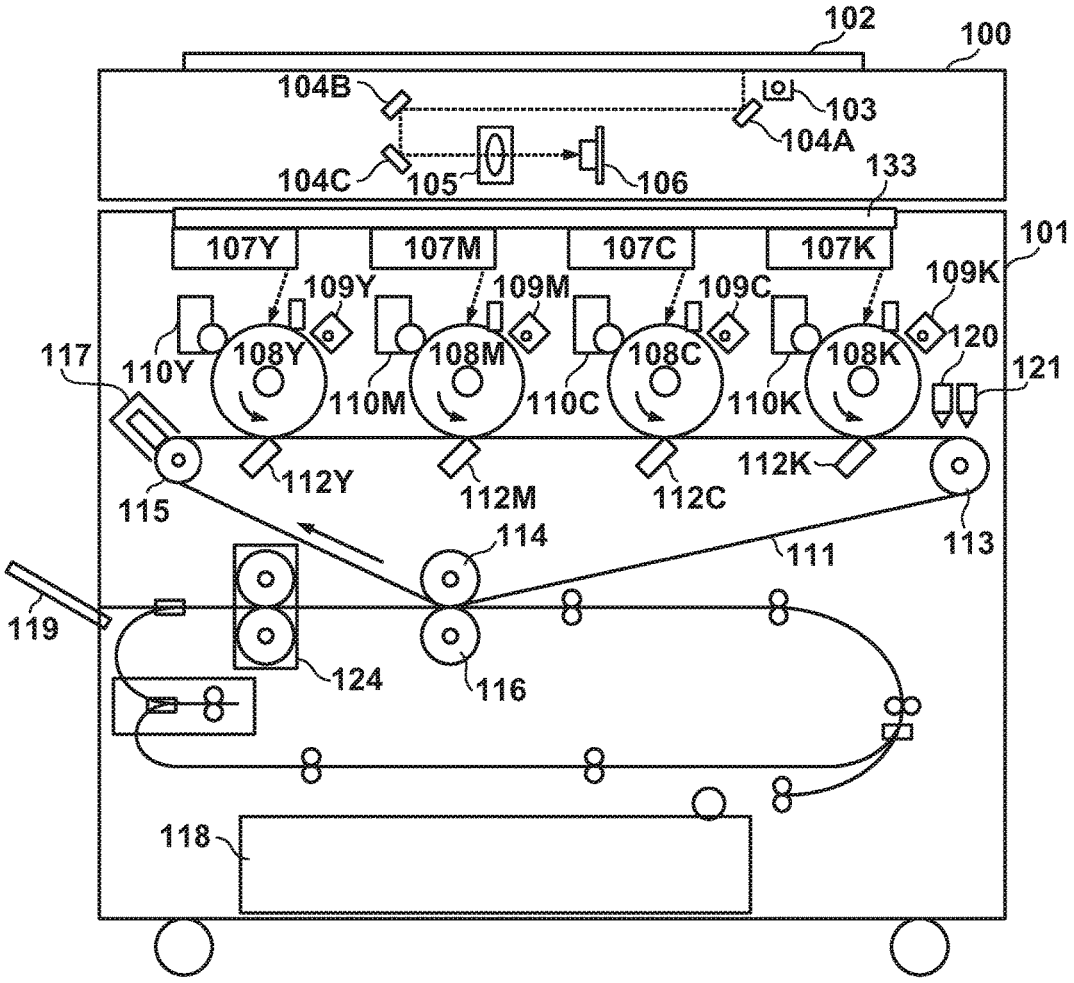
FIG. 1 is a configuration diagram of an image forming apparatus.

FIG. 1 is a configuration diagram of an image forming apparatus. An illumination lamp 103 of a reading unit 100 irradiates a light onto a document 102. The light which the illumination lamp 103 irradiated is reflected by the document 102. The reflected light from the document 102 forms an image on a color sensor 106 via mirror group 104A to 104C and a lens 105. Accordingly, the color sensor 106 generates image data which represents an image of the document 102, and outputs the image data to a controller 133. An image forming unit 101 performs image forming on a recording material based on image data for which image processing is performed in the controller 133. Note, the image forming apparatus of the present embodiment can perform image forming based on not only image data which is read by the reading unit 100 but also image data which is obtained from a telephone line, a network, or the like via an external interface.

Next, explanation of a configuration of the image forming unit 101 will be given. Note that Y, M, C, and K at the end of reference numerals in the figure respectively indicate that the colors of toner, which members or signals denoted by the reference numerals are related to forming, are yellow, magenta, cyan, or black. However, in the case where it is not necessary to distinguish a color of a toner in the explanation below, a reference numeral that excludes such a letter at the end will be used. A photosensitive member 108 is an image carrying member and is driven rotationally in a direction of an arrow symbol in the figure at the time of image forming. A charger 109 charges a surface of the photosensitive member 108 to a uniform electric potential. A scanning unit 107 scans/exposes the photosensitive member 108 based on image data which the controller 133 obtained and forms an electrostatic latent image on the photosensitive member 108. A developing unit 110 forms a toner image by developing an electrostatic latent image of the photosensitive member 108 by toner. A transfer bias is applied to a primary transfer apparatus 112 so that an electric potential difference is formed between the photosensitive member 108 and an intermediate transfer belt 111. The toner image of the photosensitive member 108 is transferred electrostatically to the intermediate transfer belt 111 by the transfer bias. Note, a full-color toner image can be formed on the intermediate transfer belt 111 by transferring an overlapped toner image of each photosensitive member 108 to the intermediate transfer belt 111.

The intermediate transfer belt 111 is stretched by a driving roller 113, a driven roller 114, and a driven roller 115 and is driven rotationally in the direction of an arrow symbol in the figure by a rotation of the driving roller 113 at the time of image forming. Accordingly, the toner image which is transferred to the intermediate transfer belt 111 is conveyed to an opposing position of a secondary transfer apparatus 116. The secondary transfer apparatus 116 outputs a transfer bias and transfers the toner image on the intermediate transfer belt 111 to a recording material which was conveyed in a conveyance path from a cassette 118. Note, a cleaning unit 117 removes a toner which is not transferred from the intermediate transfer belt 111 to the recording material and remains on the intermediate transfer belt 111. The recording material on which the toner image is transferred is conveyed to a fixing unit 124. The fixing unit 124 applies heat/pressure to the recording material, and thereby fixes the toner image onto the recording material. Then, the recording material is discharged to a tray 119. Also, at an opposing position of the intermediate transfer belt 111, a registration sensor 120 and a density sensor 121 that detect, in a color misregistration correction and a density correction, a test image for these adjustment processes are respectively arranged.

Figure 2:
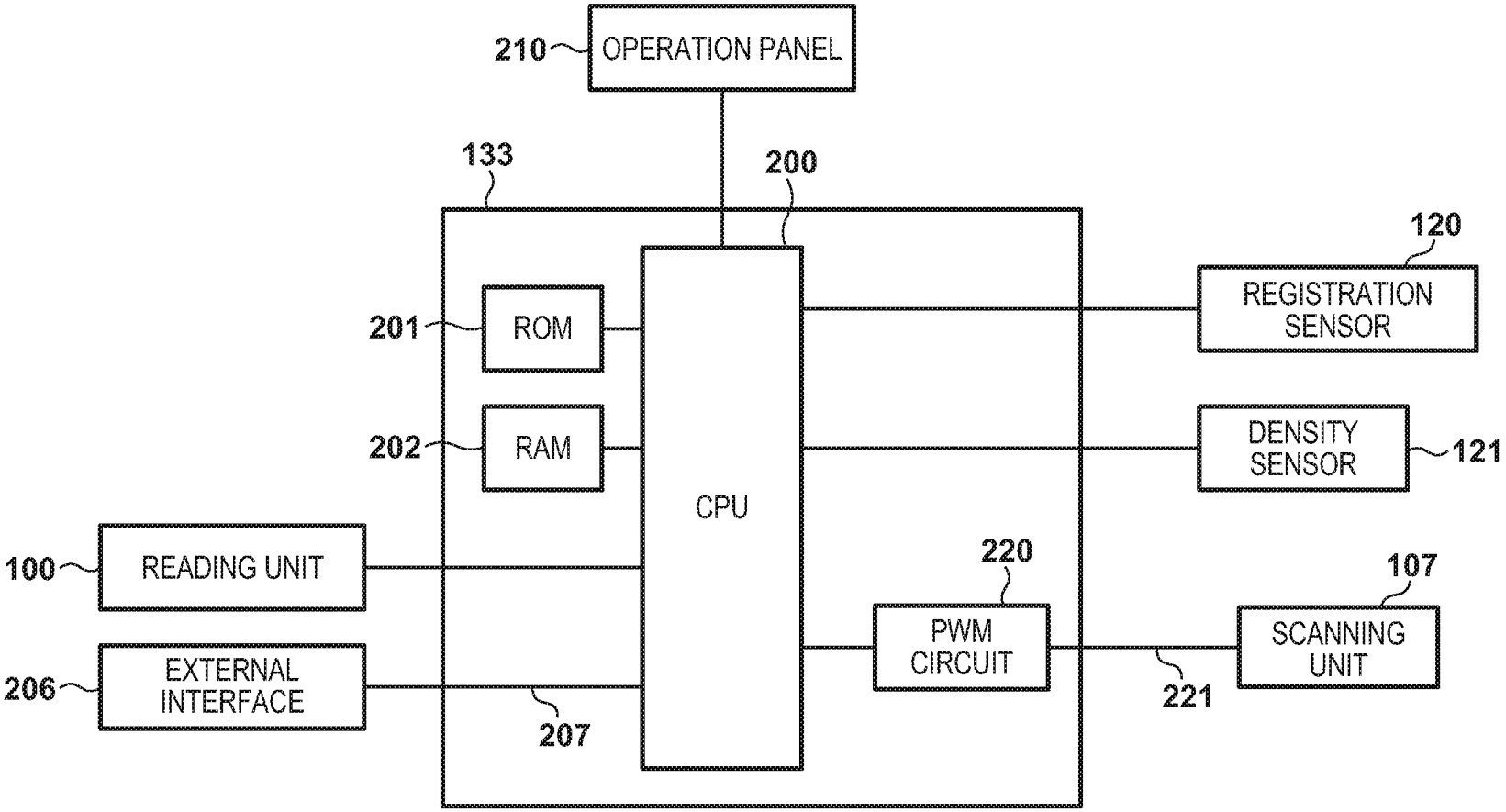
FIG. 2 is a configuration diagram of a controller.

FIG. 2 is a block diagram of the controller 133. A CPU 200 is a control unit for the image forming apparatus as a whole. The CPU 200 performs various control by executing programs which are stored in a ROM 201. A RAM 202 is used to store temporary data according to the various control which the CPU 200 performs. The reading unit 100 and an external interface 206 output to the CPU 200 image data 207 which represents an image to be formed. A PWM circuit 220 generates a PWM signal 221 for driving a light source of the scanning unit 107 based on image data processed in the CPU 200 and outputs the PWM signal 221 to the scanning unit 107. An operation panel 210 provides an input and output interface function to users.

The image forming unit 101 of the present embodiment performs image forming based on a resolution mode designated by a user from out of a plurality of resolution modes which include a normal resolution mode and a high resolution mode in which the resolution is higher than in the normal resolution mode. For example, a user can select the resolution mode by using the operation panel 210. Users can input identification information of the resolution mode via an external interface from a PC (not shown) or the like. The CPU 200 selects the resolution mode corresponding to setting information from out of the multiple resolution modes based on user setting information related to the resolution mode. Below, an explanation will be given using an example of an image forming apparatus which has a normal resolution mode in which an image of 600 dpi (600 dpi×600 dpi) is formed and a high resolution mode in which an image of 1200 dpi (1200 dpi×600 dpi) is formed. Note, the image forming unit 101 may perform image forming in one of three or more resolution modes which include a normal resolution mode and a high resolution mode.

Figure 3:
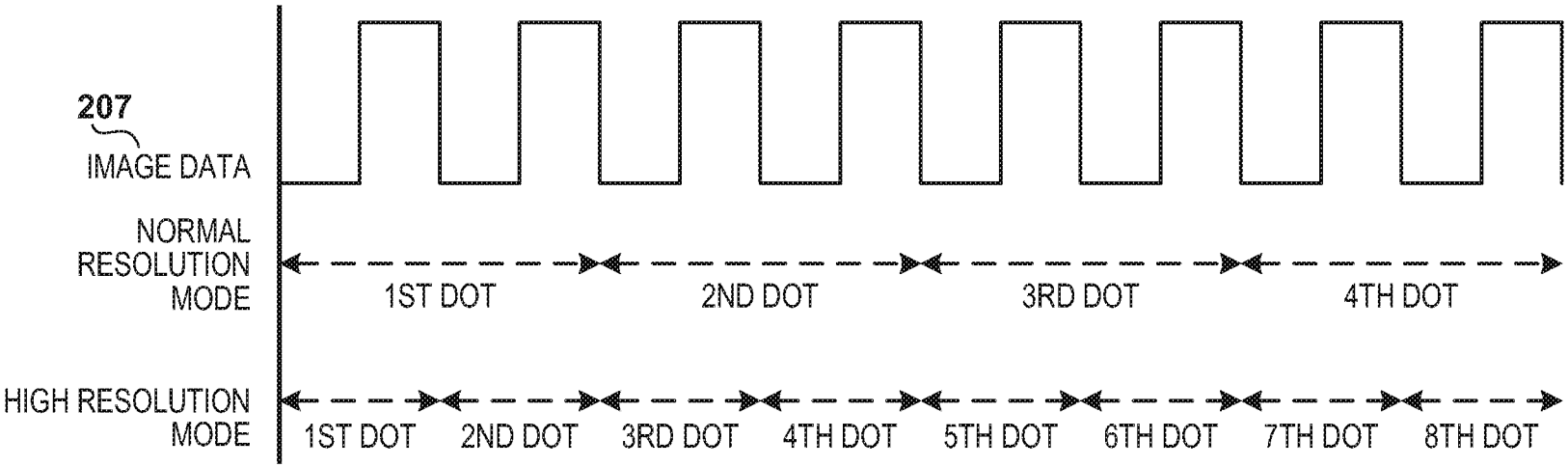
FIG. 3 is an explanatory view of a normal resolution mode and a high resolution mode.

FIG. 3 is an explanatory view illustrating a difference between dots (pixels) of the normal resolution mode and of the high resolution mode. The image data 207 indicates a tone of each dot. In the present embodiment, as an example, in the normal resolution mode 4 bits are allocated and in the high resolution mode 2 bits are allocated to express dot tone. In this way, by reducing tone information indicating a tone in the high resolution mode to half of that in the normal resolution, the CPU 200 can form dots at a density twice that of the normal resolution mode in a main scanning direction. An amount of processing on the image data 207 which is performed by the CPU 200 differs in accordance with the resolution mode. Specifically, the amount of processing on image data in the high resolution mode is more than in the normal resolution mode. For this reason, the CPU 200 makes a clock signal faster in the high resolution mode than in the normal resolution mode. The main scanning direction is a direction that the laser beam from the scanning unit 107 scans the photosensitive member 108, and the sub-scanning direction is a direction that the surface of the photosensitive member 108 moves by a rotation of the photosensitive member 108. Note, the sub-scanning direction is a direction which is orthogonal to the main scanning direction.

Figure 4:
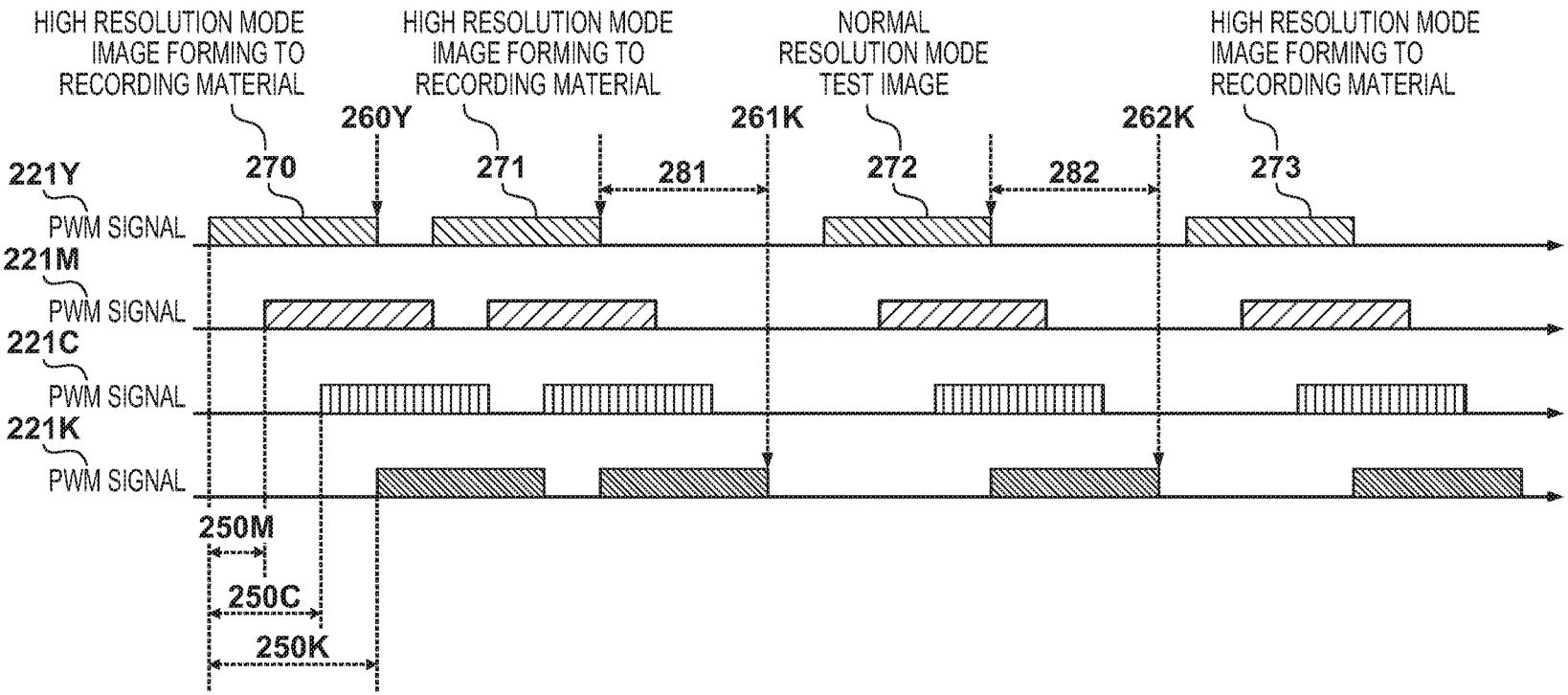
FIG. 4 is a timing diagram for a case where adjustment processing is performed between the formation of images on a recording material in the high resolution mode.

FIG. 4 is a timing diagram for a case in which an image adjustment process is performed in the normal resolution mode while image forming to recording materials is performed in the high resolution mode. In FIG. 4, reference numerals 270, 271, and 273 illustrate PWM signals which are outputted to each scanning unit to form an image on each photosensitive member in the high resolution mode. In the explanation below, images which are formed by the PWM signals indicated by the reference numerals 270, 271, and 273 are denoted respectively as images 270, 271, and 273. On the other hand, reference numeral 272 illustrates a PWM signal outputted to each scanning unit to form a test image which is used in the image adjustment processing. Note, a reason why the output timings of the PWM signals 221Y, 221M, 221C, and 221K are different is that the timings when the photosensitive members 108 transfer a toner image to the intermediate transfer belt 111 are different. That is, the intervals 250M, 250C, and 250K are decided based on the distances between the position of transfer to the intermediate transfer belt 111 of the photosensitive member 108Y and the position of the transfer to the intermediate transfer belt 111 of the photosensitive members 108M, 108C, and 108Bk, and the conveyance speed of the intermediate transfer belt 111.

The image 271 is of the same resolution mode as the image 270. In this case, each setting corresponding to the image forming of the image 271 is performed at an end timing 260Y of the PWM signal 221Y for forming the image 270. That is, each setting corresponding to the image forming of the image 271 is performed prior to completion of output of the PWM signals 221M, 221C, and 221K for forming the image 270. A setting change which influences an image to be formed, for example switching of a clock signal, is not necessary because it is the same resolution mode.

On the other hand, a setting corresponding to a test image which is formed in the normal resolution mode is performed at the output completion timing 261K of the PWM signal 221K for forming the previous the image 271. Similarly, setting corresponding to an image 273 that is formed after the test image, is performed at the output completion timing 262K of the PWM signal 221 for forming the test image. That is, settings corresponding to the test image formed in the normal resolution mode and the image 273 formed subsequently to the test image are performed at the timings of output completion for all of the PWM signals 221 for forming the previous image. This is because since switching of the resolution accompanies switching of the clock signal, the setting change cannot be performed in the middle of outputting the PWM signal 221. Accordingly, when the resolution is switched, compared to when switching is not performed, processing delays indicated by the periods 281 and 282 of FIG. 4 occur. The test image 272 is formed between the first image 271 and the second image 273. In the present embodiment, to suppress such a processing delay, in a case where a test image is formed while a plurality of images are being formed consecutively in accordance with a high resolution mode, the test image is formed without performing the switch to the normal resolution mode. Note that the test image is assumed to be a measurement image that is formed to decide image forming conditions for adjusting the maximum density of an image formed by the image forming unit 101, for example. Note, an example of an image forming condition is the intensity of the laser beam from the scanning unit 107. The image forming condition may be a charge bias supplied to the charger 109 in order to change the surface potential of the photosensitive member 108. Also, the image forming condition may be a developing bias applied to the developing unit 110.

Figure 5:
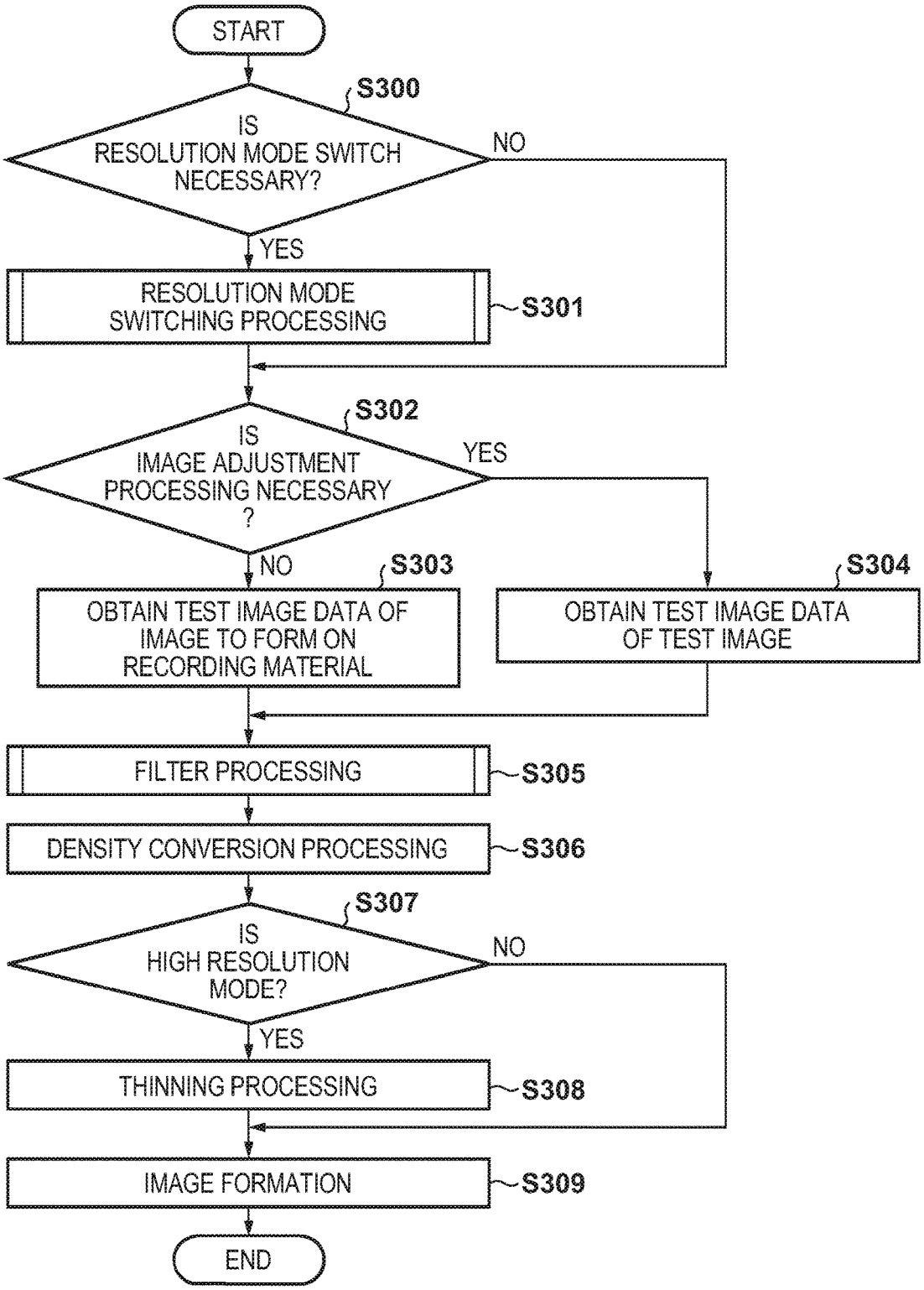
FIG. 5 is a flowchart of an image forming process.

FIG. 5 is a flowchart for an image forming process in the controller 133 according to this embodiment. The CPU 200 determines, in step S300, whether or not the switching of the resolution mode is necessary. Specifically, when the resolution of the immediately preceding image formation and the resolution of the current image formation are different, the CPU 200 determines that it is necessary to switch the resolution mode. When the switching of the resolution mode is necessary, the CPU 200, in step S301, performs processing for switching the resolution mode that includes switching to a clock signal that matches the resolution. Meanwhile, when switching of the resolution mode is not necessary, the processing of step S301 is skipped. The CPU 200 determines, in step S302, whether or not the image adjustment processing is necessary. The CPU 200 determines whether or not image adjustment processing is necessary depending on whether or not a predetermined condition is satisfied. For example, the CPU 200 can determine whether or not the image adjustment processing is necessary according to whether or not the number of image forming materials from the previous adjustment process reaches a predetermined number. When image adjustment processing is necessary, the CPU 200, in step S304, obtains test image data corresponding to the test image to be formed in the image adjustment processing. Note that the test image data is stored in the ROM 201 in advance, for example. Meanwhile, when it is not a timing at which image adjustment processing is performed, the CPU 200, in step S303, reads the image data obtained from the reading unit 100 or the external interface 206, and stores it in the RAM 202.

The CPU 200, in step S305, performs filtering processing corresponding to image data or test image data obtained in step S303 or in step S304. Note that details of the filtering process performed in step S305 are described later. The CPU 200, in step S306, in accordance with a lookup table, performs a density conversion of image data after filtering processing. The CPU 200, in step S307, determines whether or not the resolution mode is a high resolution mode. If it is the high resolution mode, the CPU 200, in step S308, performs thinning processing for image data after the density conversion. Thinning processing in the present embodiment is processing for thinning out, or in other words removing, pixels of a scanning line every other pixel in the sub-scanning direction from the information of pixels of 1200 dpi×1200 dpi. Thereby, image data configured from pixels that are 1200 dpi in the main scanning direction and 600 dpi in the sub-scanning direction is generated. In the present embodiment, it is assumed that odd-line pixels are thinned out, but configuration may be such that even-line pixels are thinned out, for example. Note that, if the resolution mode is a normal resolution mode, the processing of step S308 is skipped. The CPU 200, in step S309, outputs image data after filtering processing and after density conversion to the PWM circuit 220, and thereby a PWM signal is inputted to each scanning unit 107, and image formation is performed.

Figure 6:
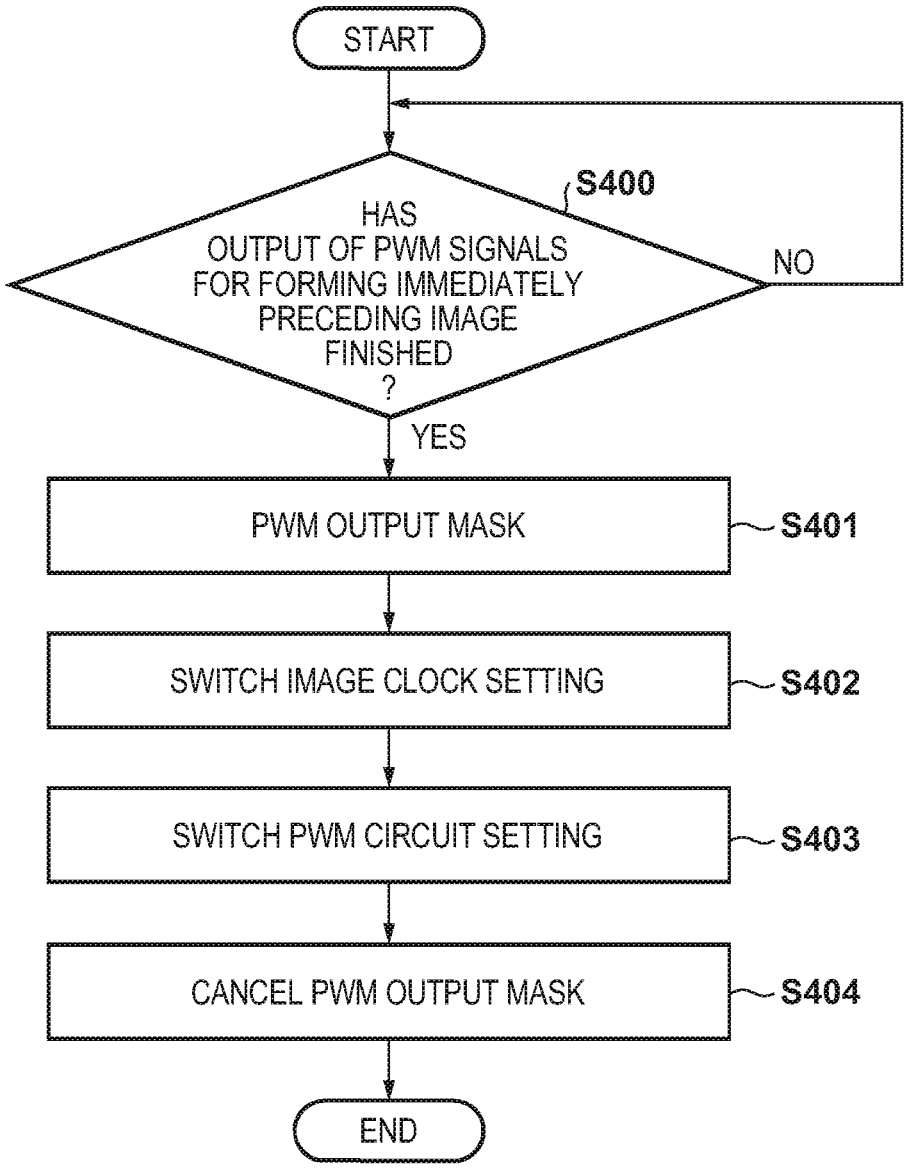
FIG. 6 is a flowchart of a resolution mode switching process.

FIG. 6 is a flowchart of a process for switching a resolution mode of step S301 of FIG. 5. The CPU 200, in step S400, waits until the PWM circuit 220 finishes outputting all of the PWM signals for forming the immediately preceding image. When outputting of all of the PWM signal completes, the CPU 200, in step S401, masks, or in other words stops, the outputting of the PWM signal of the PWM circuit 220. The CPU 200, in step S402, performs switching to a clock signal in accordance with the resolution mode. Specifically, in the case of switching from the normal resolution mode to the high resolution mode, the CPU 200 doubles the clock signal, and in the case of switching from the high resolution mode to a normal resolution, it halves the clock signal. The CPU 200, in step S403, switches the setting of the PWM circuit 220 to a setting according to the resolution mode. Specifically, because in the high resolution mode a resolution double that in the normal resolution mode is obtained, the CPU 200 sets the clock for the PWM signal to twice that of the normal resolution mode. The CPU 200, in step S404, cancels the output mask of the PWM signal masked in step S401.

Figure 7:
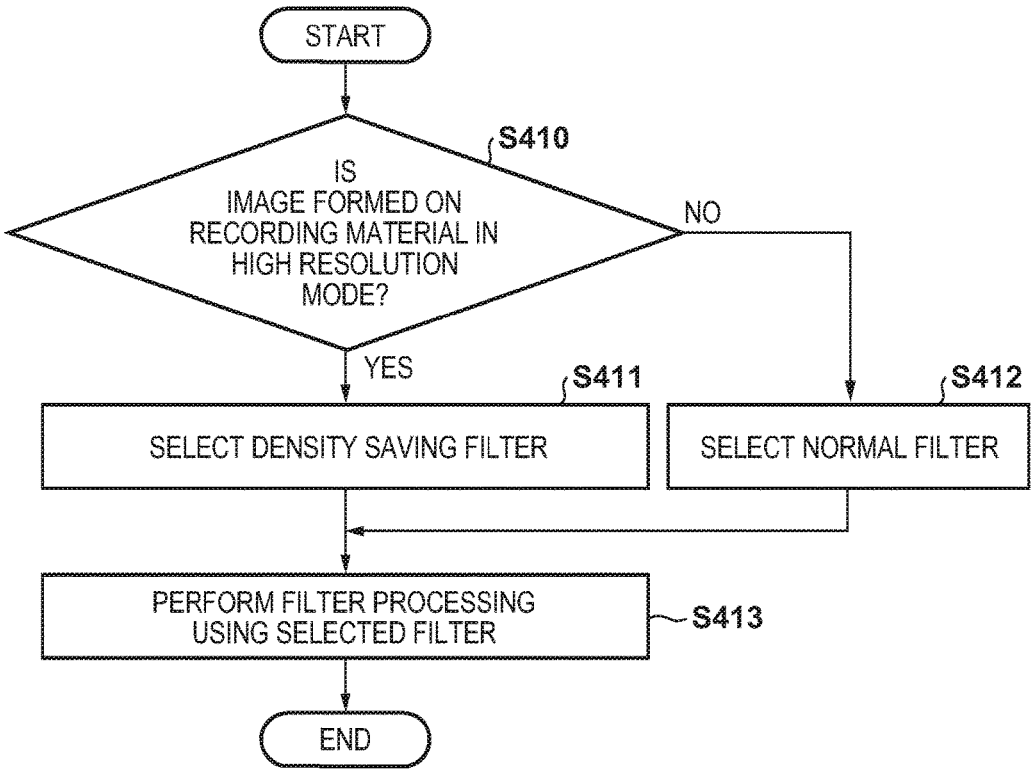
FIG. 7 is a flowchart of a filtering process.

FIG. 7 is a flowchart of a filtering process performed in step S305 of FIG. 5. The CPU 200 determines, in step S410, whether or not image formation is to a recording material in the high resolution mode. When image formation is to a recording material in the high resolution mode, the CPU 200 in step S411 selects a density saving filter. On the other hand, in the case of formation of an image to a recording material in the normal resolution mode or formation of a test image, the CPU selects a normal filter in step S412. The CPU 200, in step S413, performs filter processing by using the filter selected in step S411 or in step S412.

FIG. 8A illustrates an example of a density saving filter. Also, FIG. 8B illustrates an example of a normal filter. Note that in FIG. 8A and FIG. 8B, the horizontal direction corresponds to the main scanning direction, and the vertical direction corresponds to the sub-scanning direction. Also in FIG. 8A and FIG. 8B, each square corresponds to a pixel, and the middle value corresponds to a target pixel. Furthermore, in FIG. 8A and FIG. 8B, the value of each pixel indicates a filter coefficient. In the filtering process in step S413, the CPU 200 obtains the product of the pixel value of the target pixel after density conversion and the respective pixel values of the eight surrounding pixels with the corresponding filter coefficients. Then, the CPU 200 makes the sum of the products of the respective 9 pixels that are obtained be the pixel value of the target pixel after the filtering. In the high resolution mode, because thinning processing (step S308 of FIG. 5) is performed, as illustrated in FIG. 8A, the filter coefficients corresponding to the pixels above and below the target pixel are not 0. That is, in the density saving filter, the pixel value of the target pixel after the filtering processing depends on the pixel values prior to the filtering processing of the pixels that are neighboring in the sub-scanning direction. This is because high resolution image data is pseudo-generated in the sub-scanning direction by dispersing image signal values in the sub-scanning direction. Meanwhile, as illustrated in FIG. 8B, the filter coefficient corresponding to the pixels above and below the target pixel is 0 in the normal filter. That is, in the normal filter, the pixel value of the target pixel after the filtering processing does not depend on the pixel values prior to the filtering processing of the pixels that are neighboring in the sub-scanning direction. For this reason, the state of dispersal of image signal values in the normal resolution mode differs from the state of dispersal of image signal values in the high resolution mode. Note that the filter coefficients corresponding to the pixels above and below the target pixel are set to 0 in the case where an image is formed in the normal resolution mode on the recording material because thinning processing is unnecessary in the normal resolution mode. Below, description will be given of a reason to use a normal filter in a case of forming a test pattern.

Figure 9A:
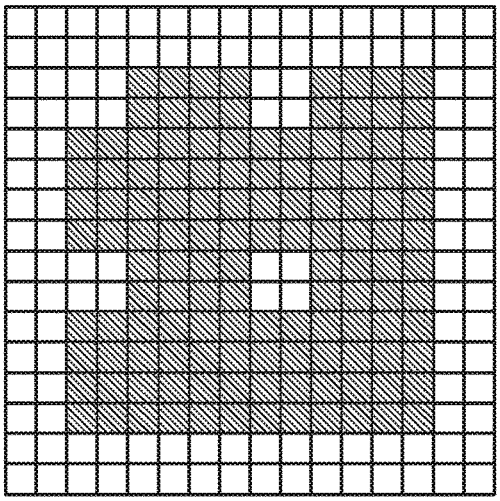
FIGS. 9A to 9C are explanatory views for filter processing by a filter used in the high resolution mode.
Figure 9B:
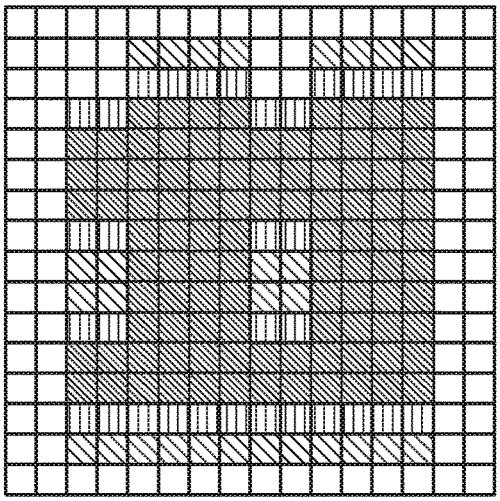
Figure 9C:
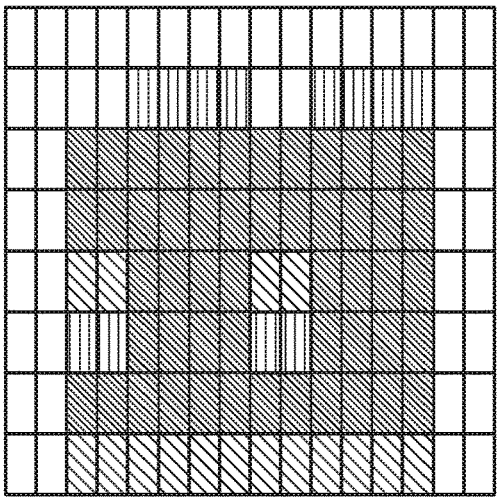

FIG. 9A illustrates a test image. FIG. 9B illustrates an image in the case where test image data corresponding to the test image of FIG. 9A is formed without thinning the result of performing filtering processing by the density saving filter illustrated in FIG. 8A. In the density saving filter, the density of an edge portion changes because the pixel values of pixels neighboring in the sub-scanning direction are distributed at a predetermined ratio. FIG. 9C illustrates an image that is actually formed by thinning the result of performing filtering processing. By thinning processing, in the present example, an image that is 1200 dpi in the main scanning direction and 600 dpi in the sub-scanning direction is formed. However, as illustrated in FIG. 9C, the edge portion in the sub-scanning direction becomes thinner. In this way, when filtering processing is performed by using a density saving filter, the intended test image cannot be formed.

Figure 10A:
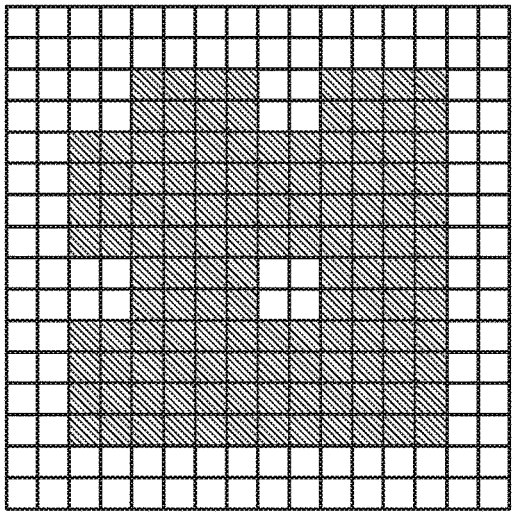
FIGS. 10A to 10C are explanatory views for filter processing by a filter used in the normal resolution mode.
Figure 10B:
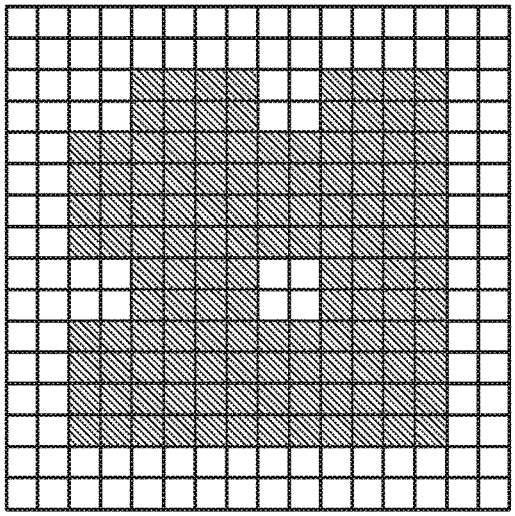
Figure 10C:
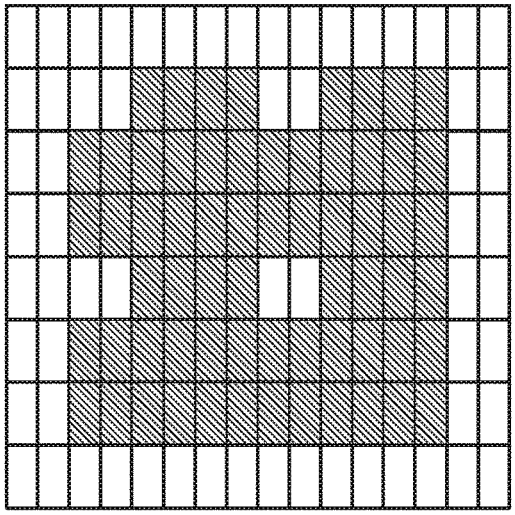

Meanwhile, FIGS. 10A to 10C illustrate a case where filtering processing is performed by using the normal filter. FIG. 10A is the same test image as in FIG. 9A. FIG. 10B illustrates an image formed without thinning the result of performing filtering processing by the normal filter on the test image data. In the normal filter, because there is no influence of pixel values of pixels that are neighboring in the sub-scanning direction, it is possible to suppress changing of the density of the edge portion. FIG. 10C illustrates an image that is actually formed by thinning the result of performing filtering processing. By thinning processing, in the present example, an image that is 1200 dpi in the main scanning direction and 600 dpi in the sub-scanning direction is formed. As illustrated in FIG. 10C, it is possible to form an intended test image by performing filtering processing by using the normal filter. Note that in the present embodiment, the calculation equations for the pixel values after filtering in the normal filter and the density saving filter are the same, and only the coefficients thereof differ. However, it is possible to use filtering by different calculation equations as the normal filter and the density saving filter. Also, it is possible to configure so that in a case of forming an image to a recording material in the high resolution mode, filter processing is performed by the density saving filter, and in a case of forming an image to a recording material in the normal resolution mode and a case of forming a test image, filtering processing is not performed. Also, it is possible to use different filters in a case of forming an image to a recording material in the normal resolution mode and a case of forming a test image.

Figure 11:
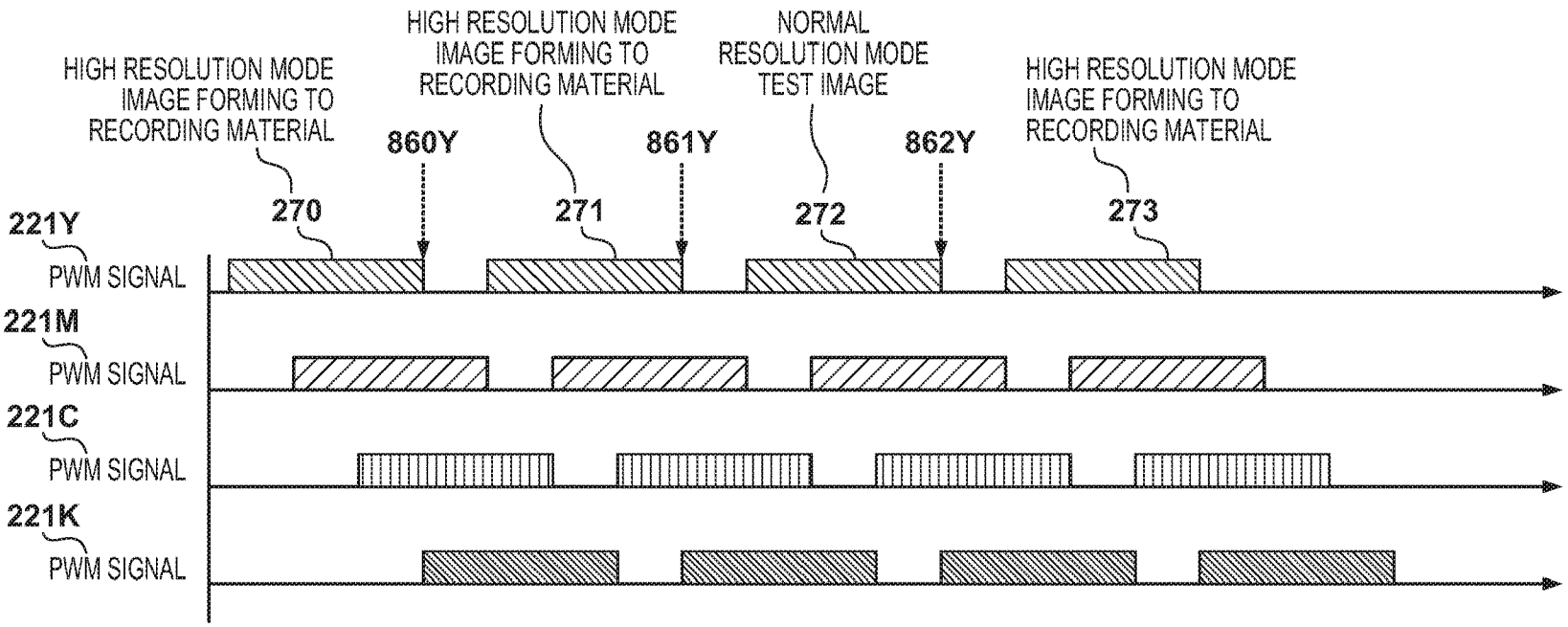
FIG. 11 is a timing diagram for a case where adjustment processing is performed while an image is formed on a recording material in the high resolution mode.

As described using FIG. 4, because adjustment processing is performed while forming the plurality of images 270, 271, and 273 to the recording material, delays denoted by the period 281 and the period 282 arise when a switching of a resolution mode is performed. Meanwhile, in the present embodiment, as illustrated in FIG. 11, the switching of the resolution mode becomes unnecessary, and so it is possible to suppress the occurrence of a delay accompanying the switching of the resolution mode. In FIG. 11, because the switching of the resolution mode does not occur, it is possible to perform a setting for the next image formation at the output completion times 860Y, 861Y, and 862Y of the PWM signal 221Y for forming the previous image. Furthermore, in the present embodiment, because the normal filter is used irrespective of the resolution mode on the test image data, it is possible to form an intended test image even if forming the test image in the high resolution mode.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-197547, filed on Oct. 5, 2016, which is hereby incorporated by reference herein in its entirety.

What is claimed is:

1. An image forming apparatus comprising:

an image processing unit configured to perform image processing to image data, the image processing including filer processing for converting a plurality of pixel values of the image data based on filter coefficients and thinning processing for thinning a plurality of pixels of the image data, wherein the filter coefficients are used to convert a target pixel based on the pixels adjacent to the target pixel in a predetermined direction;

an image forming unit configured to form an image based on the image data to which the image processing is performed by the image processing unit;

a measurement unit configured to measure a measurement image formed by the image forming unit;

a controller configured to control the image processing unit to perform the thinning processing to measurement image data without performing the filter processing, to control the image forming unit to form the measurement image based on the measurement image data to which the thinning processing is performed by the image processing unit, to control the measurement unit to measure the measurement image, and to control an image forming condition based on a measurement result of the measurement image.

2. The image forming apparatus according to claim 1, wherein the controller controls the image forming condition to adjust a maximum density of an output image to be formed by the image forming unit.

3. The image forming apparatus according to claim 1, wherein the image forming unit, comprises:

an exposure unit configured to form an electrostatic latent image by exposing a photosensitive member by using a laser beam, and wherein the image forming condition includes an intensity of the laser beam.

4. The image forming apparatus according to claim 1, wherein the image processing further includes another filter processing for converting the image data based on other filter coefficients different from the filter coefficients, the image processing unit performs the filtering processing and the thinning processing to the image data in a case where the image forming apparatus forms the image on a sheet in a first image forming mode, the image processing unit performs the other filtering processing to the image data without performing the thinning processing in a case where the image forming apparatus forms the image on the sheet in a second image forming mode, and a resolution of the image to be formed on the sheet in the first image forming mode is higher than a resolution of the image to be formed on the sheet in the second image forming mode.

5. The image forming apparatus according to claim 4, wherein the image forming unit forms the image based on a first clock signal in the first image forming mode, the image forming unit forms the image based on a second clock signal that is different to the first clock signal in the second image forming mode, and the first clock signal is faster than the second clock signal.

6. The image forming apparatus according to claim 1, wherein the image processing further includes another filter processing for converting the image data based on other filter coefficients different from the filter coefficients, the image processing unit performs the filtering processing and the thinning processing to the image data in a case where the image forming apparatus forms the image on a sheet in a first image forming mode, the image processing unit performs the other filtering processing to the image data without performing the thinning processing in a case where the image forming apparatus forms the image on the sheet in a second image forming mode, the image processing unit performs the thinning processing to the measurement image data without performing the filtering processing in a case where the image forming apparatus forms the measurement image between a first image and a second image while the image forming apparatus forms a plurality of images including the first image and the second image in the first image forming mode, and a resolution of the image to be formed on the sheet in the first image forming mode is higher than a resolution of the image to be formed on the sheet in the second image forming mode.

7. The image forming apparatus according to claim 1, wherein the image processing unit performs the filtering processing and the thinning processing to the image data in a case where the image forming apparatus forms the image on a sheet in a first image forming mode, the image processing unit does not perform the filtering processing and the thinning processing to the image data in a case where the image forming apparatus forms the image on the sheet in a second image forming mode, and a resolution of the image to be formed on the sheet in the first image forming mode is higher than a resolution of the image to be formed on the sheet in the second image forming mode.

8. The image forming apparatus according to claim 7, wherein the image forming unit forms the image based on a first clock signal in the first image forming mode, the image forming unit forms the image based on a second clock signal that is different to the first clock signal in the second image forming mode, and the first clock signal is faster than the second clock signal.

9. The image forming apparatus according to claim 1, wherein the image processing unit performs the filtering processing and the thinning processing to the image data in a case where the image forming apparatus forms the image on a sheet in a first image forming mode, the image processing unit does not perform the filtering processing and the thinning processing to the image data in a case where the image forming apparatus forms the image on the sheet in a second image forming mode, the image processing unit performs the thinning processing to the measurement image data without performing the filtering processing in a case where the image forming apparatus forms the measurement image between a first image and a second image while the image forming apparatus forms a plurality of images including the first image and the second image in the first image forming mode, and a resolution of the image to be formed on the sheet in the first image forming mode is higher than a resolution of the image to be formed on the sheet in the second image forming mode.

10. The image forming apparatus according to claim 1, wherein the plurality of pixels of the image data are thinned out every predetermined number of pixels in the predetermined direction in a case where the thinning process is performed by the image processing unit.

* * * * *